United States Patent [19]

Glass

[11] Patent Number: 4,821,160

[45] Date of Patent: Apr. 11, 1989

[54] FLANGED LOUVER CONSTRUCTION

[75] Inventor: Walter Glass, Northfield, Ill.

[73] Assignee: American Louver Company, Skokie, Ill.

[21] Appl. No.: 38,623

[22] Filed: Apr. 14, 1987

[51] Int. Cl.[4] ..... F21V 11/06

[52] U.S. Cl. ..... 362/354; 362/292

[58] Field of Search ..... 362/290, 291, 292, 325, 362/330, 342, 354

[56] References Cited

U.S. PATENT DOCUMENTS

| | | | |
|---|---|---|---|
| 2,913,576 | 11/1959 | Gilleard | 362/354 |
| 4,059,754 | 11/1977 | Lavin | 362/342 X |
| 4,272,804 | 6/1981 | Blum | 362/150 X |

FOREIGN PATENT DOCUMENTS

| | | | |
|---|---|---|---|
| 267278 | 10/1963 | Australia | 362/354 |
| 1211801 | 3/1960 | France | 362/223 |
| 689008 | 4/1965 | Italy | 362/354 |
| 993402 | 5/1965 | United Kingdom | 362/342 |

*Primary Examiner*—Tony M. Argenbright

*Attorney, Agent, or Firm*—Willian Brinks Olds Hofer Gilson & Lione Ltd.

[57] ABSTRACT

A louver construction comprising a grid formed of cubes molded unitarily with a flange extending around the periphery of the grid. The cubes include a border row making up the periphery of the grid. The cubes in the border row have different dimensions than those inside them in the grid. The flange may vary in width but the outside dimensions of the louver remain the same. As a result, the same size louver grids will fit different size light box openings.

10 Claims, 2 Drawing Sheets

FLANGED LOUVER CONSTRUCTION

FIELD OF THE INVENTION

This invention is in the field of lighting. It relates particularly to light fixtures employing fluorescent lamps as a source of light and a louver below it for controlling radiation of the light.

BACKGROUND OF THE INVENTION

The most common system for lighting office, commercial, and industrial space is overhead lighting. Conventional overhead lighting uses tubular fluorescent lamps as a light source. Depending upon the application, the light which radiates from the fluorescent lamps may pass through a louver or some other device for modifying the light rays emitted, or it may be focused by some device or left unmodified.

Light fixtures producing louvered light normally comprise a light box which contains a series of fluorescent lamps arranged longitudinally in the box. The box is open on the bottom so as to form a rectangular opening in the ceiling frame of an office, for example. Acoustic tiles form the bulk of the ceiling surface. Louvers seated in the openings in each box control light radiating downwardly from the lamps into the room below.

Although light fixtures are generally standardized as far as size is concerned, there are many manufacturers and dimensions do vary somewhat. The dimensions of the light box openings may vary from manufacturer to manufacturer and those variations have, historically, created standardization problems for louver manufacturers. The result has been louvers with varying flange configurations and louver cube arrangements to accommodate as many light box opening sizes as possible.

Prior to the development of the present invention, an extruded trim, sonically welded onto a previously cut full-grid louver, was the only practical means known to adapt plastic parabolic louvers to fit many OEM light boxes. The many manufacturing steps required to properly add an extruded trim to a plastic, parabolic louver in order for it to fit all OEM light boxes is very costly, time consuming, and presents many opportunities for errors in construction. A full grid must be cut (sawed to size), the extruded trim then cut to size (four pieces with a 45 degree mitered cut on the ends), and then the four pieces ultra-sonically welded to the cut louver.

Prior art louvers such as this result in reduced light radiation effectiveness. A reduction in total light transmitted, a reduced radiation pattern, and undesirable light pattern variations are produced.

SUMMARY OF THE INVENTION

An object of the present invention is to provide new and improved louver constructions which may be used with a range of light box openings but do not create undesirable lighting effects.

Another object is to provide new and improved louver constructions which produce highly desirable lighting effects regardless of light box opening size within a commercially available range.

A further object is to provide new and improved louver constructions of the aforedescribed nature which are considerably less expensive than conventional products.

The foregoing and other objects are realized in accord with the invention by providing a Paracube louver comprising a rectangular arrangement of standard size cubes. The standard size cubes are, in the embodiments described in relation to this invention, either 1.500 or 0.562 inches square. Each standard cube is defined by four side walls having opposed, parabolic reflecting surfaces. The use of the term "cube" does not imply that the louver components have precisely cubic configurations. Regarding the term Paracubes, it should be kept in mind that it is a trademark of the American Louver Company.

The rectangular arrangement of standard size cubes has a single row of non-standard size cubes extending around its perimeter and forming a complete border. By non-standard size it is meant that the border row of cubes has one pair of opposed side walls whose spacing is other than standard. Notwithstanding this nonstandard size, the border row of cubes does not reduce light radiation nor cause a non-uniform light pattern to be transmitted.

The border row of cubes is, in turn, encircled completely by a flange molded unitarily with the cubes. The flange widths vary on ends and sides between 1.110 inches and 1.810 inches, depending upon cube size and number. Regardless, however, the overall length of each louver is 46.750 inches and its overall width is 22.750 inches.

BRIEF DESCRIPTION OF THE DRAWINGS

The invention, including its construction and operation, is illustrated more or less diagrammatically in the drawings, in which.

DESCRIPTION OF THE PREFERRED EMBODIMENT

Figure 1:
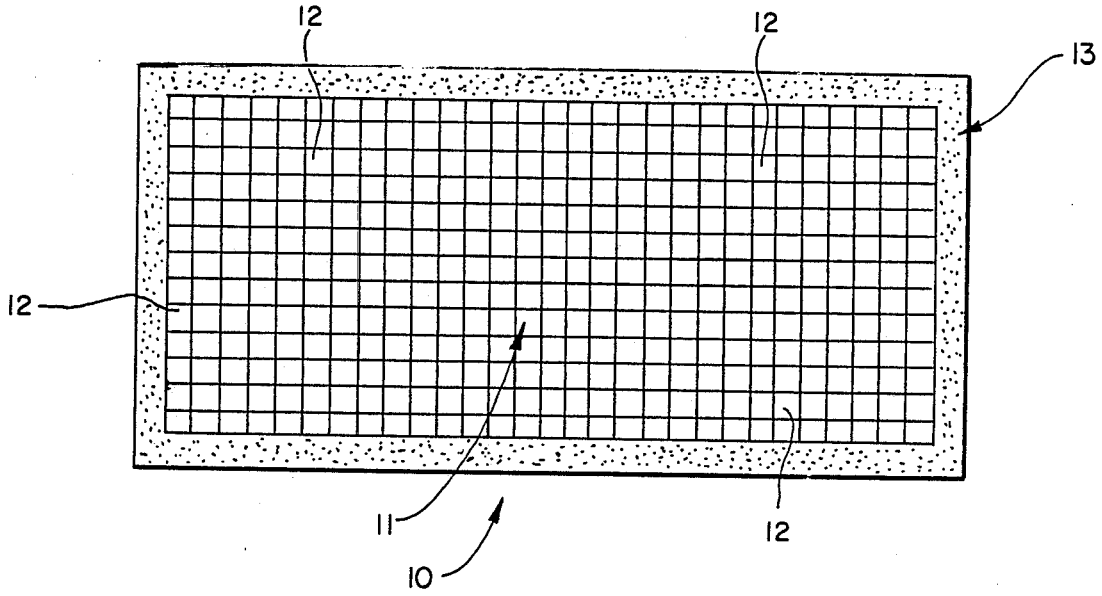
FIG. 1 is a plan view of a louver embodying features of a first form of the present invention.

Referring now to the drawings, and particularly to FIG. 1, a louver embodying a first form of the present invention is seen generally at 10. The louver 10 comprises a rectangular grid 11 of "cubes" 12 surrounded by a horizontal flange 13. The grid 11 and the flange 13 are molded in one piece of a plastic material and then coated with a highly reflective metallic coating material by conventional means.

Figure 2:
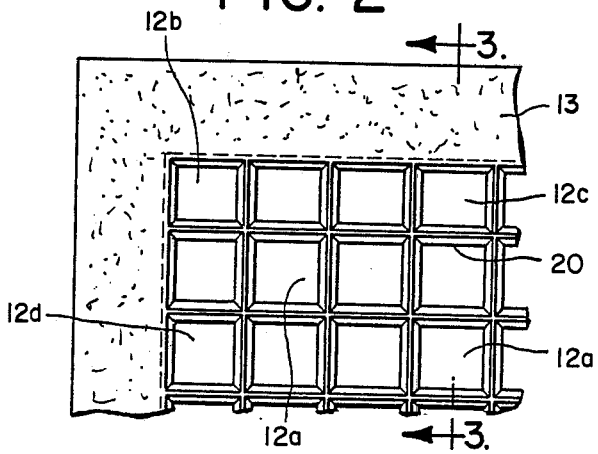
FIG. 2 is an enlarged plan view of a corner portion of the louver illustrated in FIG. 1.
Figure 3:
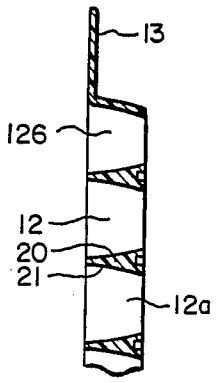
FIG. 3 is a sectional view taken along line 3—3 of FIG. 2.

As seen better in FIGS. 2 and 3, each cube 12 is made up of four side walls 20 which are mirror images of each other. Each side wall 20 has a parabolic reflecting surface 21 on it facing a corresponding surface 21 on the opposite wall.

FIG. 3 illustrates the fact that the walls 20 of all the internal cubes 12, i.e., the cubes which are not on the outer perimeter of the grid 11, are formed unitarily, back-to-back, with walls 20 of adjoining cubes 12. On the other hand, the outermost walls 20 of the perimeter cubes 12 stand alone.

In the grid 11, external plan dimensions of each internal cube 12*a* are 1.5 inches by 1.5 inches. In other words, these cubes 12*a* are square in plan view.

In contrast, the external plan dimensions of all the perimeter cubes 12 are smaller. The perimeter cubes comprise the corner cubes 12*b*, the side edge cubes 12*c*, and the end edge cubes 12*d*. Each of the corner cubes 12*b* is 1.40 inches in width and 1.30 inches in length. The perimeter cubes 12*c* are 1.30 inches in width and 1.45 inches in length. The perimeter cubes 12*d* are 1.40 inches in width and 1.45 inches in length.

The flange 13 is formed around the lower edge of the perimeter cubes 12, as best seen in FIG. 3. The flange 13 is 1.70 inches wide on the ends of the louver 10 and 1.81 inches wide on the sides.

The outside dimensions of the flanged louver 10 embodying features of the present invention are 46.75 inches in length and 22.75 inches in width. The louver 10 is effective to transmit light through it without a pattern or halo effect.

Figure 4:
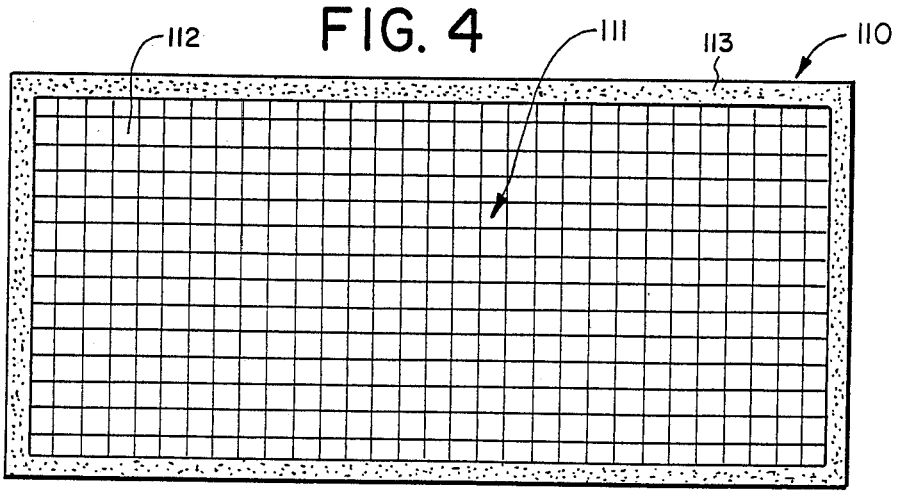
FIG. 4 is a plan view of a louver embodying features of a second form of the present invention.
Figure 5:
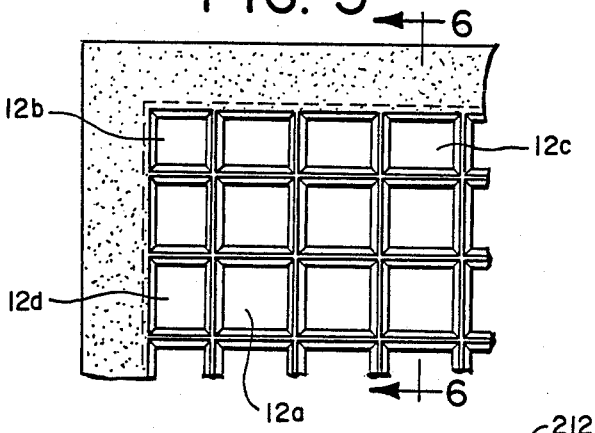
FIG. 5 is an enlarged plan view of a corner portion of the louver illustrated in FIG. 4.

Turning now to FIG. 4, a louver embodying a second form of the present invention is seen generally at 110. The louver 110 comprises a rectangular grid 111 of "cubes" 112 surrounded by a horizontal flange 113. The grid 111 and the flange 113 are molded in one piece of a plastic material and then coated with a highly reflective metallic coating material.

Referring to FIGS. 2 and 3, each cube 112 is made up of four side walls 120 which are mirror images of each other. Each side wall 120 has a parabolic reflecting surface 121 on it facing a corresponding surface 121 on the opposite wall.

FIG. 3 illustrates the fact that, like the wall 20 of the cubes 12 in the louver 10 hereinbefore discussed, all of the internal cubes 112 are formed unitarily with the walls of adjoining cubes 112. On the other hand, the outermost walls 120 of the perimeter cubes 112 stand alone.

In the grid 111, external plan dimensions of each internal cube 112*a* are again 1.5 inches by 1.5 inches. In other words, these cubes 112*a* are also square in plan view.

In contrast, the external plan dimensions of all the perimeter cubes 112 are smaller. The perimeter cubes comprise the corner cubes 112*b*, the side edge cubes 112*c*, and the end edge cubes 112*d*. Each of the corner cubes 112*b* is 1.15 inches in width and 1.15 inches in length. The perimeter cubes 12*c* and 12*d* are 1.40 inches in width and 1.30 inches in length.

Figure 6:
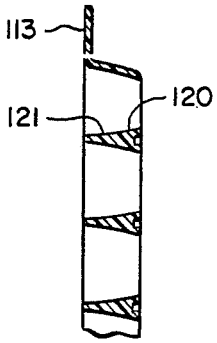
FIG. 6 is a sectional view taken along line 6—6 of FIG. 5.

The flange 113 is formed around the lower edge of the perimeter cubes 12, as best seen in FIG. 6. The flange 113 is 1.2 inches wide around the entire periphery of the louver 110.

The outside dimensions of the flanged louver 110 embodying features of the second form of the present invention are also 46.75 inches in length and 22.75 inches in width. The louver 110 is effective to transmit light through it without a pattern or halo effect in a manner similar, in both light intensity and distribution, to the louver 10 hereinbefore discussed in relation to the first form of the present invention.

Figure 7:
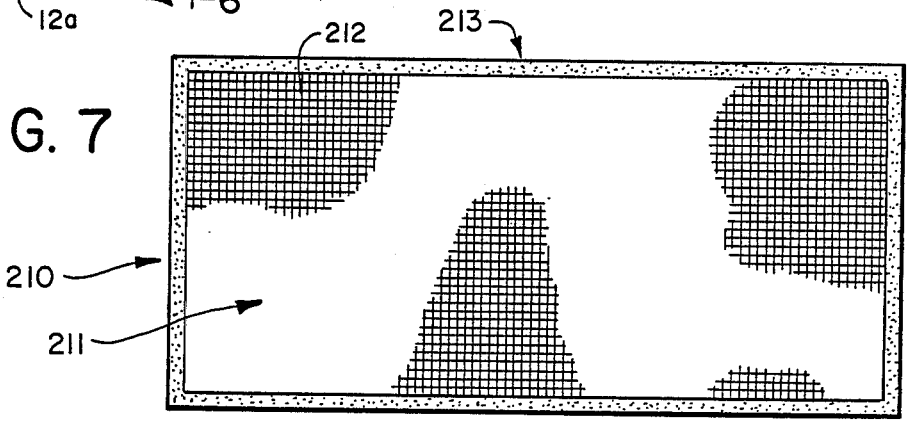
FIG. 7 is a plan view of a louver embodying features of a third form of the present invention.

Turning now to FIG. 7, a louver embodying a third form of the present invention is seen generally at 210. The louver 210 comprises a rectangular grid 211 of "cubes" 212 surrounded by a horizontal flange 213. The grid 211 and flange 213 are molded in one piece of a plastic material and then coated with metallic coating material.

Figure 10:
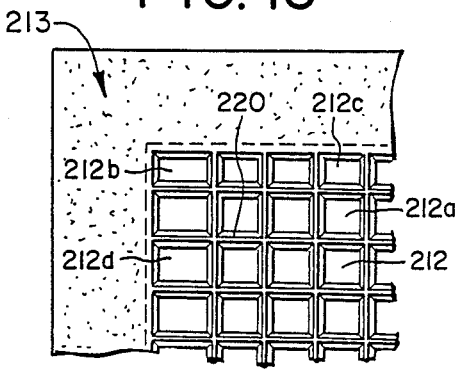
FIG. 10 is an enlarged plan view of a corner portion of the louver illustrated in FIG. 9.

Referring to FIG. 10, each cube 212 is made up of four side walls 220 which are mirror images of each other. In this regard, the construction and configuration of the cubes 212 is similar to those hereinbefore discussed.

In the grid 211, the external plan dimensions of each internal cube 212*a* are 0.562 inches by 0.562 inches. In other words, these cubes 212*a* are also square in plan view.

The external plan dimensions of all the perimeter cubes 212 are different. The perimeter cubes comprise the corner cubes 212*b*, the side edge cubes 212*c* and the end edge cubes 212*d*. Each of the corner cubes 212*b* is 0.430 inches in width and 0.658 inches in length. The perimeter cubes 212*c* are 0.562 inches in length and 0.430 inches in width. The perimeter cubes 212*d* are 0.658 inches in length and 0.562 inches in width.

The flange 213 is formed around the lower edge of the perimeter cubes 212. The flange 213 is 1.110 inches in width along the sides of the louver 210 and 1.080 inches in width along the end of the louver.

The outside dimensions of the flanged louver 210 embodying features of the third form of the present invention are also 46.75 inches in length and 22.75 inches in width. The louver 210 is also effective to transmit light through it without a pattern or halo effect in a manner similar, in both light intensity and distribution, to the louvers hereinbefore discussed in relation to the other forms of the present invention.

Figure 9:
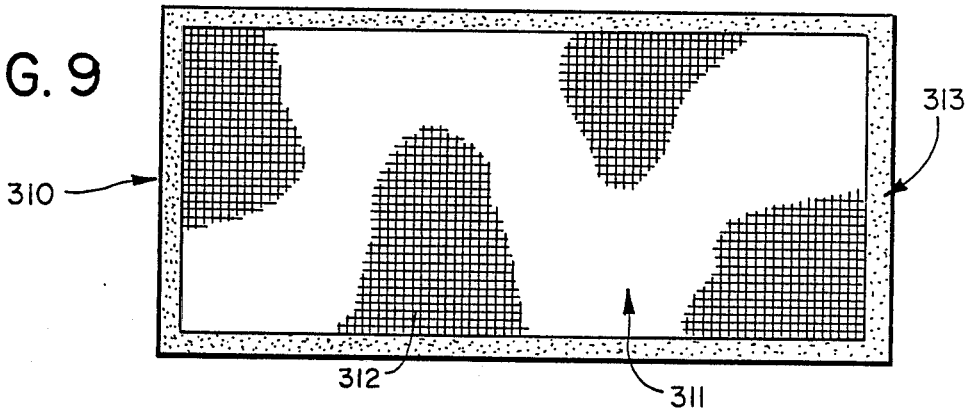
FIG. 9 is a plan view of a louver embodying features of a fourth form of the present invention.

Turning now to FIG. 9, a louver embodying a fourth form of the present invention is seen generally at 310. The louver 310 comprises a rectangular grid 311 of "cubes" 312 surrounded by a horizontal flange 313. The louver 310, as with those previously described, is formed unitarily.

Figure 8:
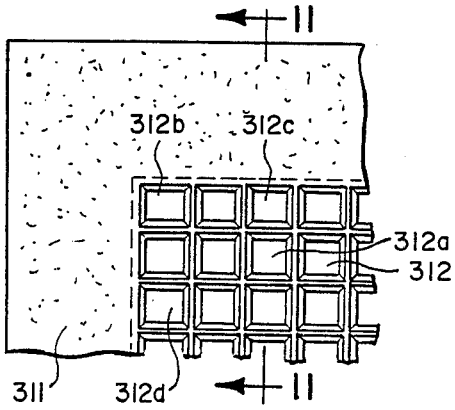
FIG. 8 is an enlarged plan view of a corner portion of the louver illustrated in FIG. 7.
Figure 11:
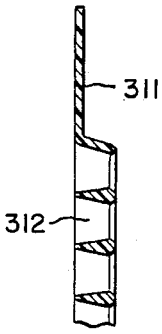
FIG. 11 is a sectional view taken along line 11—11 of FIG. 8.

Referring to FIGS. 8 and 11, each cube 312 is constructed in a manner identical to the cubes 212 previously discussed. In the grid 311, external plan dimensions of each internal "cube" 312*a* are 0.562 inches by 0.562 inches. In contrast, the external plan dimensions of all the perimeter cubes 312 are smaller. The perimeter of cubes comprise the corner cubes 312*b*, the side edge cubes 312*c*, and the end edge cubes 312*d*.

Each of the corner cubes 312*b* is 0.522 inches in width and 0.549 inches in length. The perimeter cubes 312*c* are 0.562 inches in length and 0.522 inches in width. The perimeter cubes 312*d* are 0.549 inches in length and 0.562 inches in width.

The outside dimensions of the flanged louver 310 embodying features of the present invention are 46.75 inches in length and 22.75 inches in width. The louver 310 is also effective to transmit light through it without a pattern or halo effect.

While the process and product embodiments described herein are at present considered to be preferred, it is understood that various modifications and improvements may be made therein, and it is intended to cover in the appended claims all such modifications and improvements as fall within the true spirit and scope of the invention.

I claim:

1. A louver for a light box, or the like, comprising:
(a) a rectangular grid of cubes including a plurality of internal cubes and a row of perimeter cubes forming a border around said internal cubes;
(b) all of said internal cubes being square in external plan configuration and having first predetermined identical lengths and widths;
(c) all of said border row of cubes being other than square in plane configuration and having second predetermined lengths and widths, at least one of said second predetermined length and width in each border row cube differing from a corresponding one of said first predetermined length and width in an internal cube;
(d) said border row of cubes comprising end edge cubes, side edge cubes, and corner edge cubes;
(e) said end edge cubes having at least one of a length or width dimension different than any length or width dimension of said side edge cubes; and
(f) a flange formed unitarily with and around the periphery of said border row of cubes and protruding outwardly therefrom;
(g) said grid and said flange being molded in one piece.

2. The louver of claim 1 further characterized in that:
(a) said flange extends along both the sides and ends of said grid; and
(b) the width of said flange along said sides of said grid being different than the width of said flange along the ends of said grid.

3. The louver of claim 2 further characterized in that:
(a) said louver, including said grid and said flange, is 46.750 inches in length and 22.750 inches in width.

4. The louver of claim 1 further characterized in that:
(a) said first predetermined identical lengths and widths are each 0.562 inches.

5. The louver of claim 4 further characterized in that:
(a) said flange extends along the sides and the ends of said grid;
(b) the width of said flange along said sides of said grid being different than the width of said flange along the ends of said grid.

6. The louver of claim 5 further characterized in that:
(a) said louver, including said grid and said flange, is 46.750 inches in length and 22.750 inches in width.

7. A louver for a light box, or the like, comprising:
(a) a rectangular grid of cubes including a plurality of internal cubes and a single row of perimeter cubes forming a border around said internal cubes;
(b) all of said internal cubes being square in external plan configuration and having identical lengths and widths of 1.500 inches;
(c) all of said border row cubes being other than square in plan configuration and having lengths between 1.30 inches and 1.45 inches, and widths between 1.30 inches and 1.40 inches;
(d) a flange formed unitarily with and around the periphery of said border row of cubes and protruding outwardly therefrom;
(e) said flange being 1.70 inches in width along the ends of said louver and 1.18 inches in width along the sides of said louver; and
(f) said grid and said flange being molded in one piece.

8. A louver for a light box, or the like, comprising:
(a) a rectangular grid of cubes including a plurality of internal cubes and a single row of perimeter cubes formed a border around said internal cubes;
(b) all of said internal cubes being square in external plan configuration and having identical lengths and widths of 1.500 inches;
(c) all of said border row cubes being other than square in plan configuration and having lengths between 1.15 inches and 1.30 inches, and widths between 1.15 inches and 1.40 inches;
(d) a flange formed unitarily with and around the periphery of said border row of cubes and protruding outwardly therefrom;
(e) said flange being 1.20 inches in width along the sides and ends of said louver; and
(f) said grid and said flange being molded in one piece.

9. A louver for a light box, or the like, comprising:
(a) a rectangular grid of cubes including a plurality of internal cubes and a single row of perimeter cubes forming a border around said internal cubes;
(b) all of said internal cubes being square in external plan configuration and having identical lengths and widths of 0.562 inches;
(c) all of said border row cubes being other than square in plan configuration and having lengths between 0.562 inches and 0.658 inches, and widths between 0.430 inches and 0.562 inches;
(d) a flange formed unitarily with and around the periphery of said border row of cubes and protruding outwardly therefrom;
(e) said flange being 1.080 inches in width along the ends of said louver and 1.110 inches in width along the sides of said louver; and
(f) said grid and said flange being molded in one piece.

10. A louver for a light box, or the like, comprising:
(a) a rectangular grid of cubes including a plurality of internal cubes and a single row of perimeter cubes forming a border around said internal cubes;
(b) all of said internal cubes being square in external plan configuration and having identical lengths and width of 0.562 inches;
(c) all of said border row cubes being other than square in plan configuration and having lengths between 0.549 inches and 0.562 inches, and widths between 0.522 inches and 0.562 inches;
(d) a flange formed unitarily with and around the periphery of said border row of cubes and protruding outwardly therefrom; and
(e) said grid and said flange being molded in one piece.

* * * * *